US007070383B2

(12) United States Patent
Sugimoto

(10) Patent No.: US 7,070,383 B2
(45) Date of Patent: Jul. 4, 2006

(54) BOOM ASSEMBLY FOR SWIVELING UTILITY VEHICLE

(75) Inventor: Takatoshi Sugimoto, Sakai (JP)

(73) Assignee: Kubota Corporation, Osaka (JP)

( * ) Notice: Subject to any disclaimer, the term of this patent is extended or adjusted under 35 U.S.C. 154(b) by 209 days.

(21) Appl. No.: 10/652,583

(22) Filed: Aug. 29, 2003

(65) Prior Publication Data

US 2005/0047899 A1 Mar. 3, 2005

(30) Foreign Application Priority Data

Sep. 24, 2002 (JP) ..... 2002-276700

(51) Int. Cl.
*E02F 9/00* (2006.01)

(52) U.S. Cl. ..... 414/694; 414/918

(58) Field of Classification Search ..... 414/694, 414/686, 680, 722, 723, 918
See application file for complete search history.

(56) References Cited

U.S. PATENT DOCUMENTS

| | | | | |
|---|---|---|---|---|
| 4,193,734 | A | 3/1980 | Williams | |
| 5,108,253 | A | 4/1992 | Kobayashi et al. | |
| 5,176,491 | A | 1/1993 | Houkom | |
| 5,806,313 | A | 9/1998 | Koshi et al. | |
| 6,872,043 | B1 * | 3/2005 | Yukawa et al. | 414/694 |
| 2003/0210972 | A1 | 11/2003 | Yukawa et al. | |

FOREIGN PATENT DOCUMENTS

| | | | |
|---|---|---|---|
| DE | 199 58 696 | A1 | 6/2001 |
| JP | 11-13083 | | 1/1999 |
| JP | 2001 081808 | A | 3/2001 |
| JP | 2001 323494 | A | 11/2001 |
| JP | 2002 285574 | A | 10/2002 |
| JP | 2003 003511 | A | 1/2003 |

* cited by examiner

*Primary Examiner*—Donald W. Underwood
(74) *Attorney, Agent, or Firm*—The Webb Law Firm

(57) ABSTRACT

A boom assembly includes a hollow bent boom pivotally connected to a swing bracket, a hollow arm pivotally connected to a leading end of the boom and pivotally supporting an implement at a leading end of the arm, a pair of right and left connecting brackets attached to opposed side faces of a base end of the arm, an implement cylinder provided between the implement and the connecting brackets for operating the implement, a hydraulic service port for a hydraulic implement, and a hydraulic oil pipe for supplying pressure oil to the implement cylinder and the hydraulic service port. The hydraulic service port is provided in the connecting brackets and the hydraulic oil pipe extends through the inside of the hollow boom to be exposed to the outside from a back face area of the leading end of the boom and then further extends between the pair of right and left connecting brackets. A portion of the leading end of the hydraulic oil pipe is connected to the implement cylinder and a further portion thereof is connected to the hydraulic service port.

4 Claims, 10 Drawing Sheets

BOOM ASSEMBLY FOR SWIVELING UTILITY VEHICLE

BACKGROUND OF THE INVENTION

1. Field of the Invention

The present invention relates to a boom assembly swingably supported to a receiving bracket attached to a front of a swivel table of a swiveling utility vehicle such as a backhoe.

2. Description of the Related Art

In a backhoe, for instance, a swivel table is supported to a vehicle body having a crawler traveling unit, with the table being swivelable about a vertical shaft and a boom assembly is attached to the front of this swivel table.

In the boom assembly, a swing bracket is supported via a receiving bracket to the front of the swivel table, with the bracket being pivotable about a vertical axis. To this swing bracket, there are connected a base end of a boom formed as a hollow structure having a bent intermediate portion and also an end of a boom cylinder for lifting the boom. At the leading end of the boom there is pivotally supported, via a pivot shaft, a base end of an arm formed as a hollow structure. A pair of right and left connecting brackets are provided adjacent the pivot shaft for the arm. An arm cylinder for moving up and down the arm is connected between the connecting brackets and the boom. The arm pivotally supports at the leading end thereof an implement such as a bucket. An implement cylinder for pivoting the implement is connected between the implement and the connecting brackets.

Further, in the boom assembly of the above type, a hydraulic pipe for a bucket cylinder, an external or auxiliary hydraulic implement or the like is often provided on the outer side faces of the boom and the arm. However, a different construction is known from e.g. Japanese Patent Application "Kokai" No.: Hei. 11-13083, in which the hydraulic oil pipes are inserted within the boom and the arm connecting brackets. More particularly, in this boom assembly, the hydraulic oil pipe for external implement is extended to the vicinity of the arm and a hose joint acting as a service port is attached to the top face (back face) of the arm, so as to allow the external hydraulic implement to be used at a position far from the swivel table. However, since the hose joint is attached to the top face of the arm where the bucket cylinder is provided, there tends to occur interference between the hydraulic oil pipe connected to the hose joint and the further hydraulic oil pipe connected to the bucket cylinder, so that with activation of the bucket cylinder, the two oil pipes can come into sliding contact with each other to be damaged thereby. Also, because of the presence of the bucket cylinder, a connecting operation of the hose to the hose joint is difficult.

SUMMARY OF THE INVENTION

The present invention addresses to the above-described problem. A primary object of the invention is to provide a boom assembly for a swiveling utility vehicle which assembly can avoid physical interference between a service port and a hydraulic oil pipe connected thereto and a hydraulic oil pipe connected to a bucket cylinder and which allow facilitates a connecting operation of an external hydraulic implement hose to the service port.

For accomplishing the above-noted object, a boom assembly, according to the present invention, comprises: a swing bracket pivotally connected to a receiving bracket of a swivel table to be pivotable about a vertical axis; a hollow bent boom pivotally connected to the swing bracket; a boom cylinder for lifting the boom; a hollow arm pivotally connected to a leading end of the boom and pivotally supporting an implement at a leading end of the arm; a pair of right and left connecting brackets attached to opposed side faces of a base end of the arm; an arm cylinder provided between the connecting brackets and the boom for moving up and down the arm; an implement cylinder provided between the implement and the connecting brackets for operating the implement; a hydraulic service port for a hydraulic implement; and a hydraulic oil pipe for supplying pressure oil to the implement cylinder and the hydraulic service port;

wherein said hydraulic service port is provided in said connecting brackets and said hydraulic oil pipe extends through the inside of the hollow boom to be exposed to the outside from a back face area of the leading end of the boom and then further extends between said pair of right and left connecting brackets; and wherein a portion of the leading end of the hydraulic oil pipe is connected to said implement cylinder and a further portion thereof is connected to said hydraulic service port.

With the above-described construction, physical interference between a service port and a hydraulic oil pipe connected thereto and a hydraulic oil pipe connected to a bucket cylinder can be avoided and a connecting operation of an external hydraulic implement hose to the service port is facilitated.

According to one preferred embodiment of the invention, said hollow arm includes a top plate which is sectioned along the length thereof into an upper portion and a lower portion across a stepped portion therebetween; and said hydraulic service port comprises a pipe joint which is disposed in a space delimited by said lower portion and said pair of connecting brackets and arranged closer to the arm base portion than to the implement cylinder. With this construction, physical interference between the hydraulic oil pipe for supplying pressure oil to the implement cylinder and the external hydraulic implement and the arm can be restricted. Further, this construction provides a greater space available for the hydraulic oil pipe, thereby to reduce the possibility of interference between the pipe and the arm. In addition, the construction allows for a greater length of welding line for welding the connecting brackets and the arm together.

According to a further preferred embodiment of the invention, said pipe joint constituting the service port extends through the inside of the connecting brackets to the outside and a hose joint is connected to the leading end of the pipe joint. This construction facilitates the connecting operation of an external hydraulic implement hose to the hose joint.

Further and other features and advantages of the invention will become apparent upon reading the following detailed disclosure of the invention with reference to the accompanying drawings.

DESCRIPTION OF THE PREFERRED EMBODIMENTS

Preferred embodiments of the invention will now be described in details with reference to the accompanying drawings.

Figure 7:
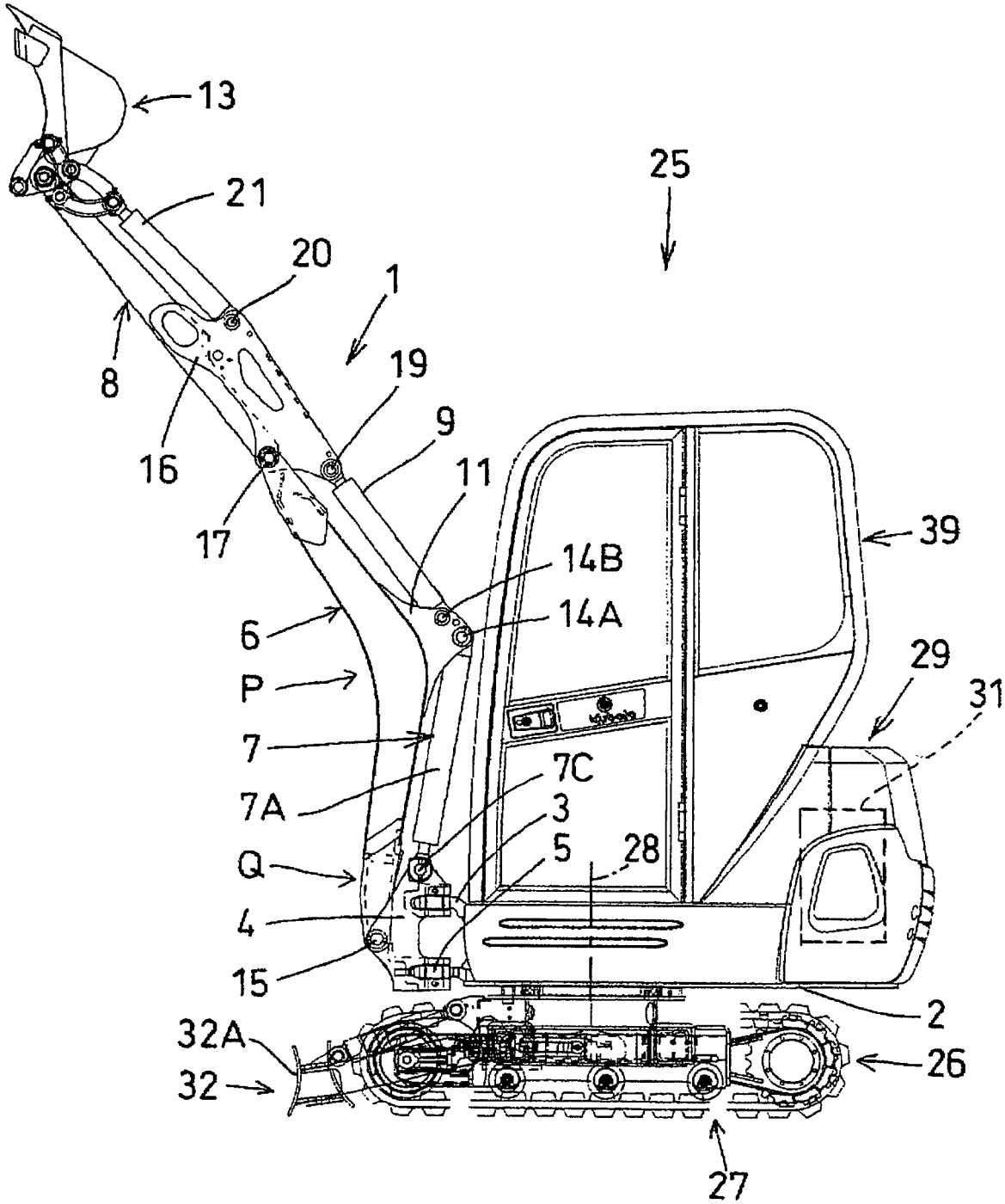
FIG. 7 is a side view showing a backhoe in its entirety.
Figure 8:
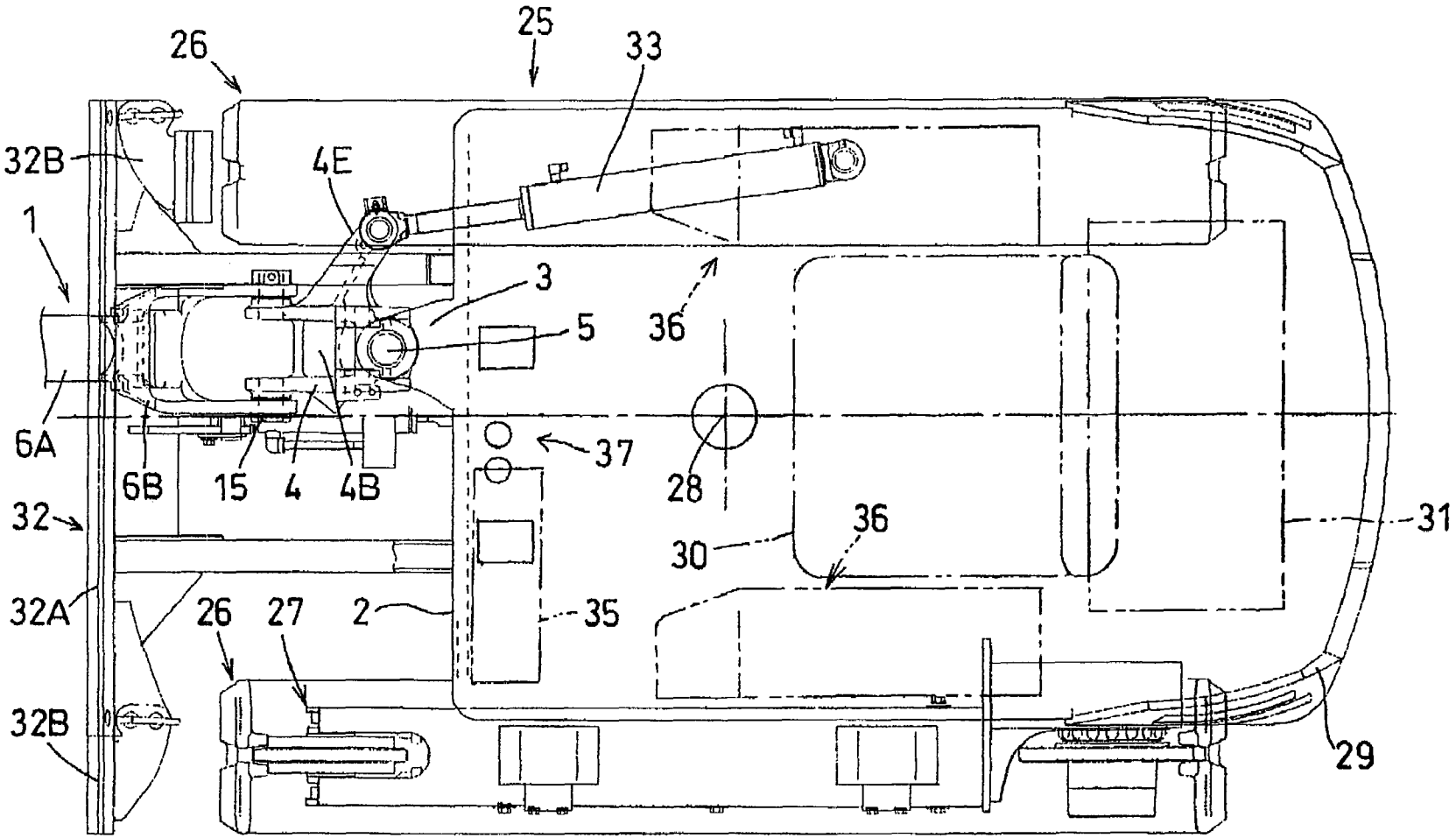
FIG. 8 is an explanatory plan view of the backhoe.
Figure 9:
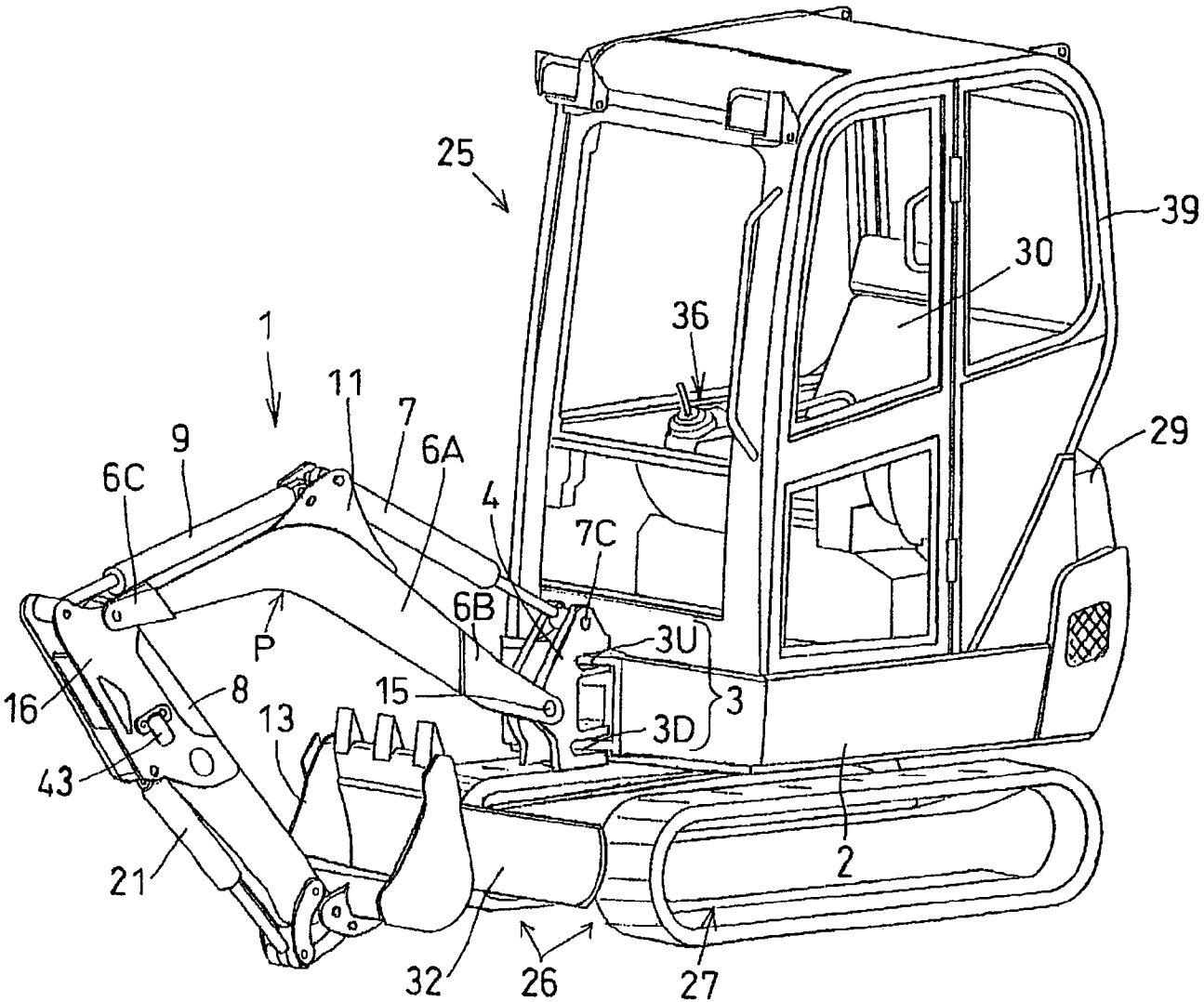
FIG. 9 is a perspective view showing the backhoe in its entirety.

In FIGS. 7–9, numeral 25 denotes a backhoe as an example of a swiveling utility vehicle. In this backhoe 25, a swivel table 2 is supported to a traveling vehicle body 27 having right and left crawler traveling units 26, with the table 2 being swivelable about a swivel shaft 28 provided as a vertical shaft. And, a boom assembly 1 is attached to the front of this swivel table 2.

The swivel table 2 mounts an engine 31 at the rear portion thereof and mounts also a fuel tank on the right side and an oil tank, an oil filter, etc. on the left side thereof, with these mounted components being covered with a floor sheet, a cover 29 or the like. Further, a driver's seat 30 is provided forwardly of the engine 31 and rearwardly of the boom assembly 1. On the right and left sides of the driver's seat 30, implement controllers 36 are provided. And, forwardly of the driver's seat 30, there is provided a controlling console 37 for traveling and swiveling. And, a driver's cabin 39 is provided for surrounding all these components.

In its plan view, the swivel table 2 has right and left sides extending substantially parallel with each other along the fore and aft direction of the vehicle, a front side extending substantially parallel with the right and left direction of the vehicle and a rear side formed arcuate. The table 2 mounts the boom assembly 1 at a position projecting from the front side thereof. Further, in this swivel table 2, a distance from the swivel shaft 28 to the rear end of the table 2 is about twice the distance from the shaft 28 to the front end of the table 2, so that this table 2 is provided as a so-called compact standard swiveling type table 2.

The right and left crawler traveling units 26 are movable to the right and left relative to the vehicle body 27. That is, these units allow inter-track distance adjustment. In FIG. 8, the lower side than the center line shows a condition realized with setting the inter-track distance to the maximum, whereas the upper side than the center line shows a condition realized with setting the inter-track distance to the minimum. With the minimum setting of the inter-track distance, the outer side faces of the right and left crawler traveling units 26 extend substantially flush or slightly concave/convex relative to the swivel table 2 and the driver's cabin 39.

Further, a dozer device 32 attached to the front of the vehicle body 27 to be liftable relative thereto includes a blade 32A and extension blades 32B extending from the right and left ends of the blade 32A. When the extension blades 32B are retracted, the right and left dimension of the blade 32A corresponds substantially with the minimum inter-track distance of the right and left traveling crawler units 26. When the extension blades 32B are extended, the right and left dimension of the blade corresponds substantially with the maximum inter-track distance of the right and left traveling crawler units 26.

In FIGS. 1–4 and 7–9, the boom assembly 1 includes a receiving bracket 3 provided at the front of the swivel table 2. This receiving bracket 3 is formed integrally with a member forming the swivel table 2 or formed separately. The receiving bracket 3 includes at the front thereof vertically separated receiving portions 3U, 3D projecting forwardly. And, these upper and lower receiving portions 3U, 3D define holes for inserting vertical shafts 5.

The boom assembly 1 includes a swing bracket 4 pivotally supported to the receiving bracket 3 via the vertical shaft 5, a boom 6 having a base end thereof pivotally supported to the swing bracket 4, an arm (vertically movable member) 8 attached to a leading end of the boom 6 to be pivotable about a horizontal shaft 17, and a bucket (implement) 13 pivotally supported via a horizontal shaft 47 to a leading end of the arm 8.

In operation, the boom 6 can be lifted via a boom cylinder 7 from an elevated posture shown in FIG. 7 to a lowered posture into the ground. And, with the respective postures of the boom 6, the arm 8 can be moved up and down by an arm cylinder (vertically movable cylinder) 9. And, at the respective postures of the boom 6 and the arm 8, the bucket 13 can be operated by a bucket cylinder (implement cylinder) 21 for scooping and dumping operations. The cylinders 7, 9 and 21 comprise hydraulic cylinders.

Figure 1:
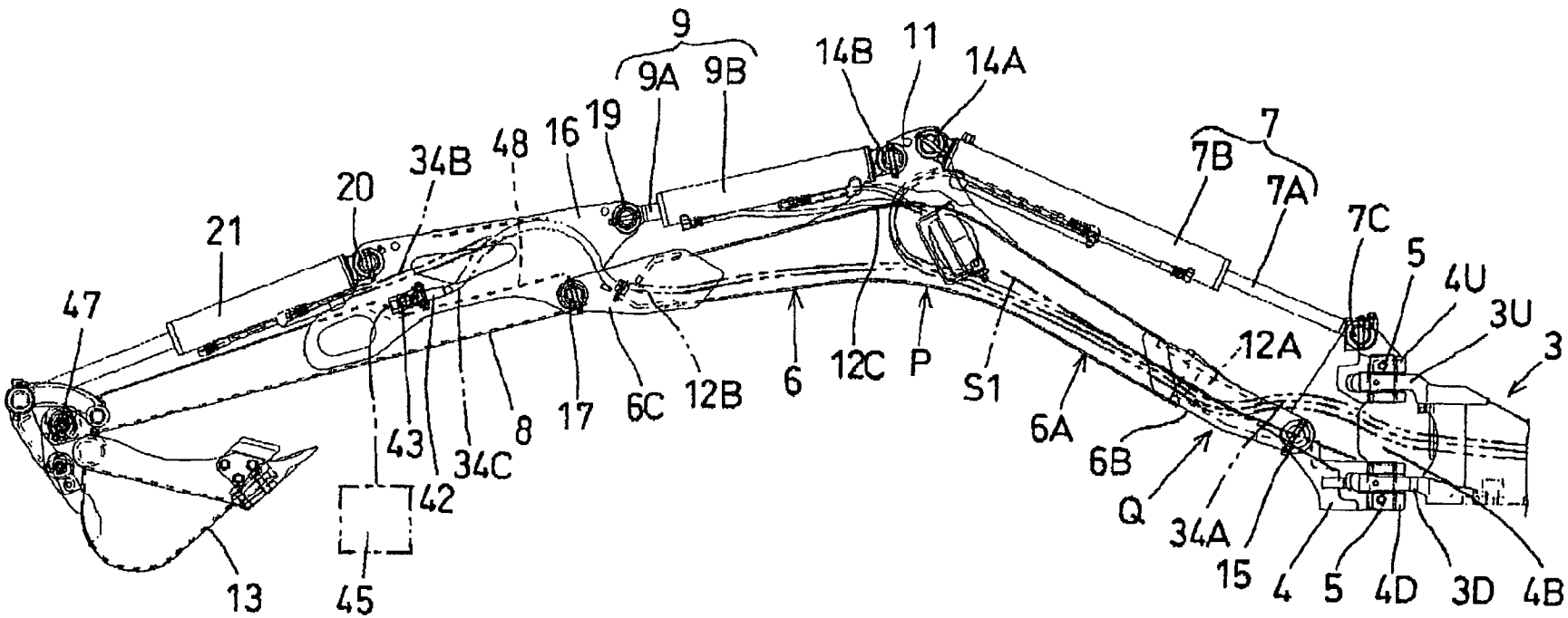
FIG. 1 is an overall side view showing an embodiment of a boom assembly relating to the present invention.
Figure 2:
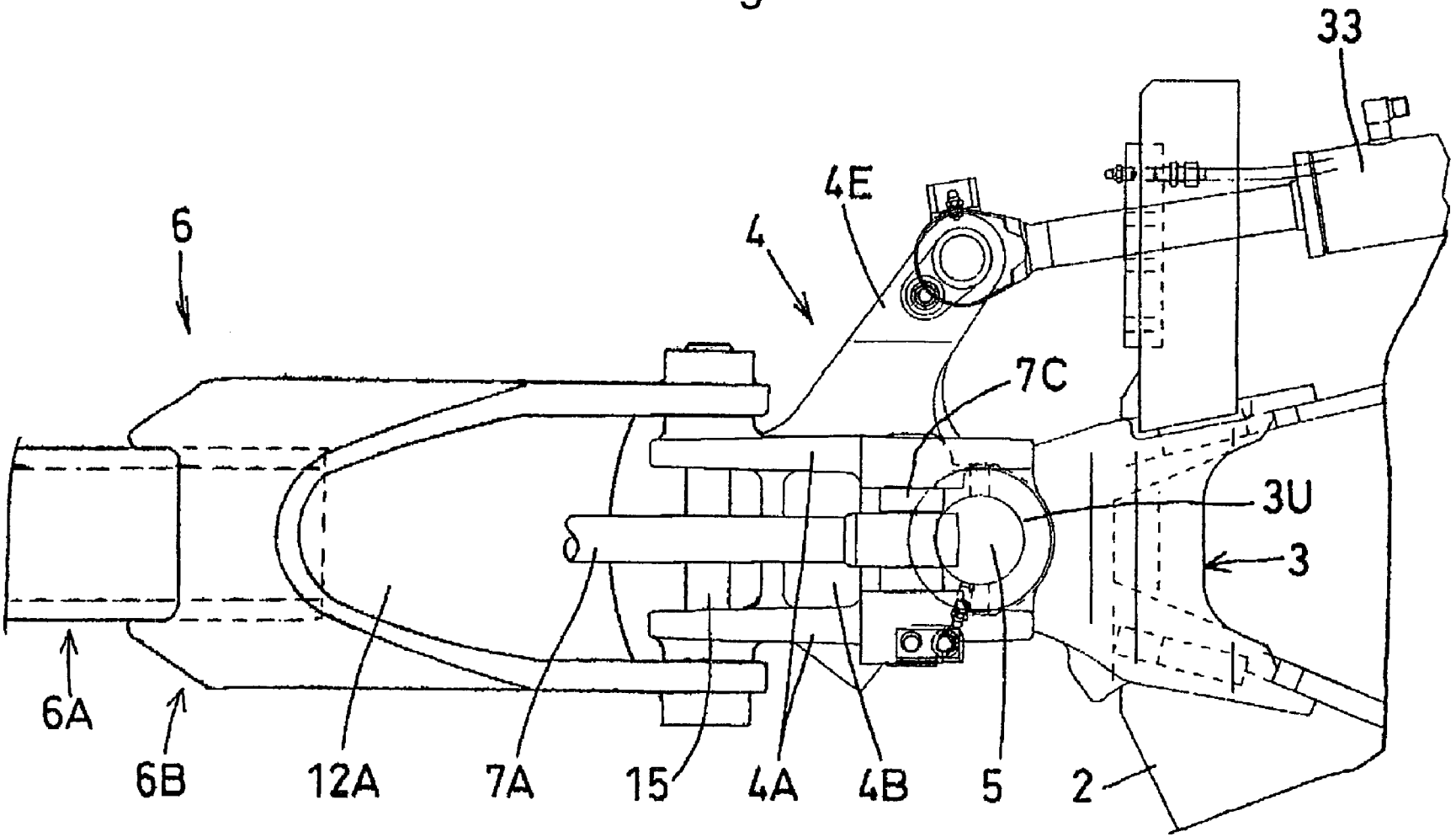
FIG. 2 is a plan view showing a base end area of the boom assembly.
Figure 3:
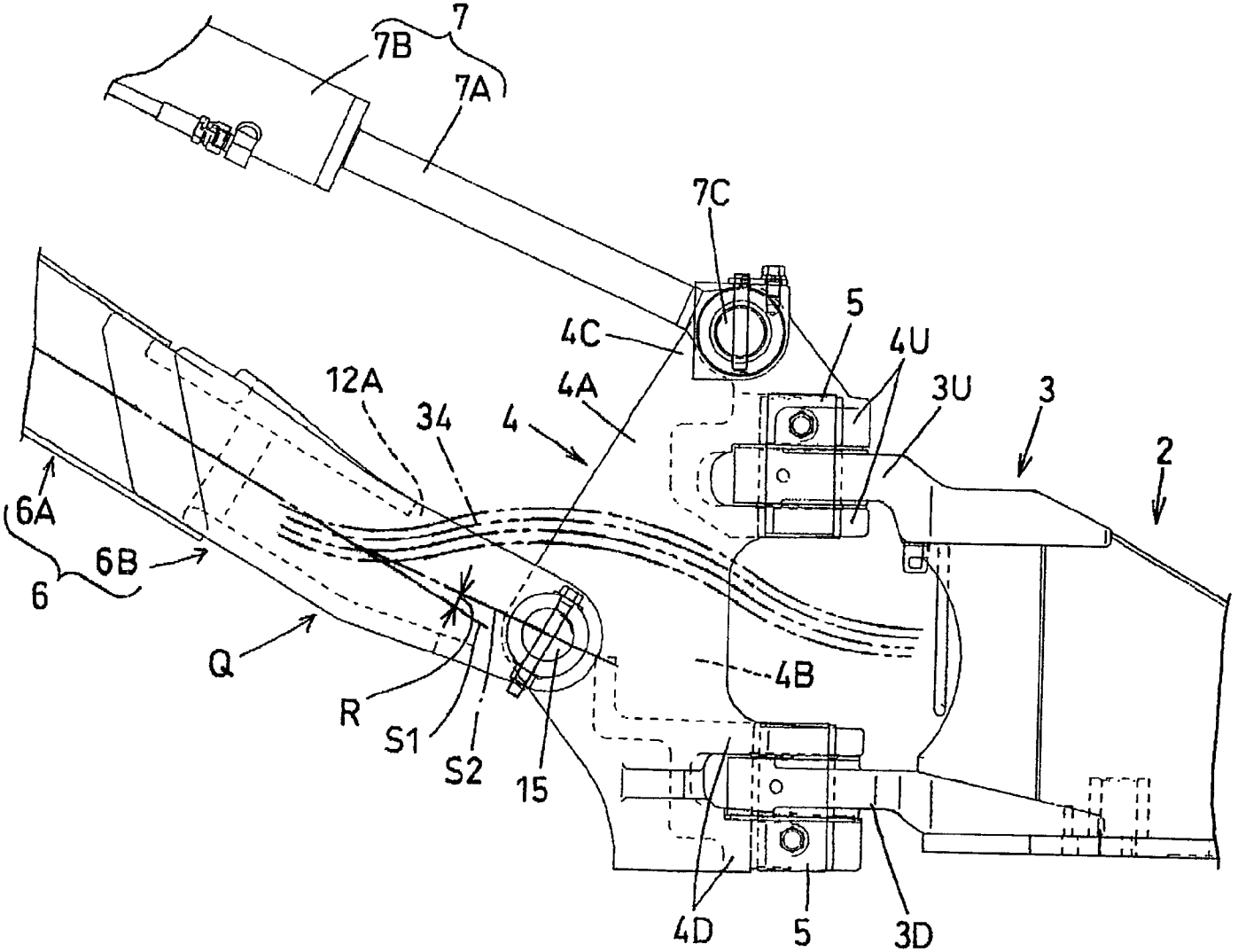
FIG. 3 is a side view showing the base end area of the boom assembly.
Figure 4:
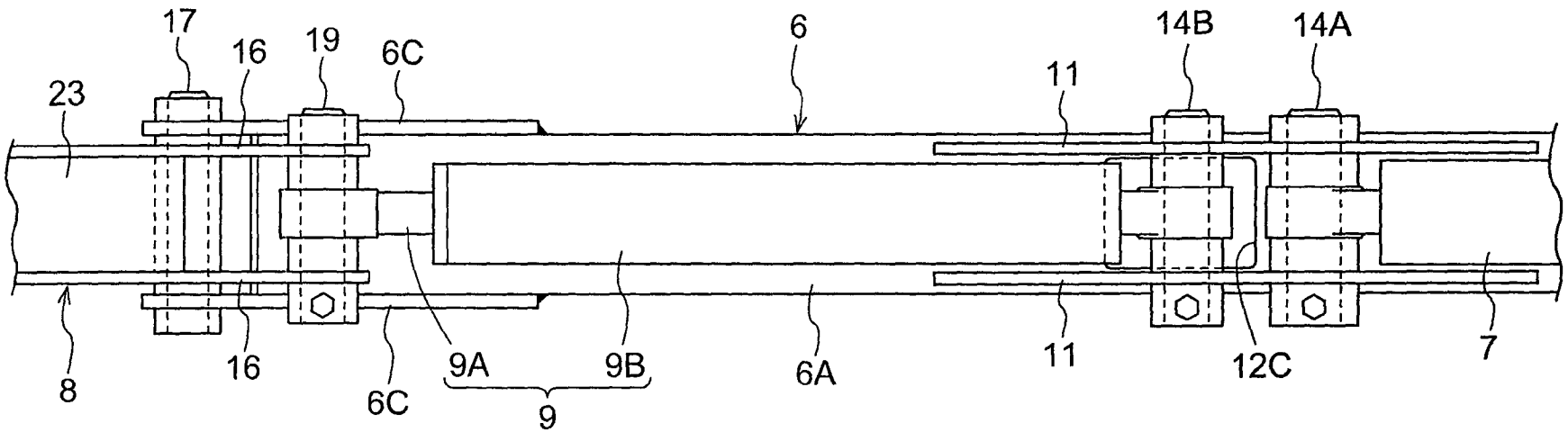
FIG. 4 is a plan view showing an intermediate area of the boom.

Referring to FIGS. 1 through 3, the swing bracket 4 includes upper and lower support portions 4U, 4D each being a bifurcate member. And, these upper and lower support portions 4U, 4D include holes for allowing insertion of the vertical shafts 5. The upper support portion 4U is engaged with the upper receiving portion 3U and the lower support portion 4D is engaged with the lower receiving portion 3D. And, with insertion of the vertical shafts 5 into these, the swing bracket 4 is coupled with the receiving bracket 3 to be pivotable to the right and left.

The vertical shafts 5 are two separate coaxial upper and lower shafts 5. The upper shaft 5 connects the upper receiving portion 3U and the upper support portion 4U together. The lower shaft 5 connects the lower receiving portion 3D and the lower support portion 4D together. And, there is formed a free space between these upper and lower shafts 5. Instead, only one vertical shaft 5 may be provided to be inserted through the upper and lower assemblies.

Referring to the swing bracket 4, the intermediate portion thereof between the upper and lower support portions 4U, 4D is bifurcated in the right and left direction. And, a hole is formed as being surrounded by right and left side walls 4A and the upper and lower support portions 4U, 4D. And, this hole is provided as an insertion hole 4B for a hydraulic oil pipes 34 as will be described later herein. Further, to this bracket 4, a base end portion 6B of the boom 6 is engaged to be pivotally supported via the horizontal shaft 15.

The swing bracket 4 further includes a connecting arm portion 4E extending laterally from one of the upper and lower support portions 4U, 4D. To this connecting arm portion 4E, there is connected a piston rod of the swing cylinder 33 pivotally supported to the swivel table 2 (see FIG. 8 also).

The swing bracket 4 further includes a connecting arm portion 4E extending laterally from one of the upper and lower support portions 4U, 4D, to this, there is connected a piston rod of the swing cylinder 33 pivotally supported to the swivel table 2.

The connecting pin 7C to which the cylinder rod 7A is connected is located substantially upwardly of the vertical shaft 5 to be sufficiently close to the swing table 2. With this, the boom 6 and the boom cylinder 7 may be disposed as close as possible to the vertical shafts 5 and the swivel table 2. As the result, the projecting amount of the swing bracket 4 forming the outermost end at the front of the swivel table 2 projecting from the swivel table 2 may be reduced, thereby to reduce the maximum turning radius of the front portion of the swivel table 2. As a result, this arrangement can advantageously reduce the possibility of contact with an external object and can also improve the weight balance of the vehicle.

Referring to FIGS. 1 through 5, the boom 6 includes a body 6A formed as a tubular, i.e. hollow, structure having a substantially rectangular cross section by either welding upper and lower plates to a pair of right and left side plates of plate metal or fixing a plate member to an opening side of a member having a bent cross section for closing the opening. And, a longitudinally intermediate portion of this tubular body 6A is formed as a bent portion P which is bent as seen in a side view thereof. Further, into the opposed ends of this body 6A, the base end member 6B and the leading end member 6C formed by casting are fixedly inserted.

The joining portion between the body 6A and the leading end member 6C is inclined relative to the longitudinal direction of the boom 6 for providing a greater length available for the welding and also for avoiding stress concentration at a single point in the longitudinal direction for effective stress distribution.

The base end member 6B and the leading end member 6C need not be cast members, but may be forged members or steel worked members. Further, the body 6A, the base end member 6B and the leading end member 6C may be formed integral of a same material.

Further, in this boom 6, between the bent portion P and the base end, there is formed a reverse-bent portion Q bent reversely relative to the hook of the bent portion P of the body 6A. More particularly, an intermediate portion of the base end member 6B is bent to project in the direction away from the boom cylinder 7.

Therefore, as shown in FIG. 3, a center line S2 extending from the reverse-bent portion Q to the horizontal shaft 15 intersects, by an angle R, a longitudinal center line S1 of the boom 6.

The reverse-bent portion Q extends away from the cylinder rod 7A to form a free space between this portion and the rod. So that, when the boom 6 is pivoted upward to the substantially uppermost elevated posture shown in FIG. 7 or the boom 6 is pivoted downward to the substantially lowermost lowered posture, there occurs no interference between this boom 6 and the cylinder 7. The reversed-bent portion Q allows for increase of the vertical pivotal angle of the boom 6 without contact with the upper support portion 4U. The portion Q also allows the horizontal shaft 15 provided at the base end of the boom 6 to be disposed as close as possible to the vertical shaft 5.

Incidentally, this reverse-bent portion Q may be formed in the body 6A per se or at the joining portion between the body 6A and the leading end member 6C. However, forming this portion Q in the base end member 6B alone is more advantageous since this will not invite deterioration in strength due to the hook, so that the required strength can be easily assured.

In the back faces of the base end member 6B and the leading end member 6C, there are formed insertion holes 12A, 12B communicated with the inside of the hollow body 6A. With this, the boom 6 is formed hollow continuously through the entire length thereof for allowing insertion of the hydraulic oil pipes 34.

The insertion hole 12A of the base end member 6B is provided as an inlet opening for introducing the hydraulic oil pipes 34 for feeding the pressure oil to the boom cylinder 7, the arm cylinder 9, the bucket cylinder 21, the external hydraulic implement 45, etc. through the insertion hole 4B of the swing bracket 4 into the hollow boom 6.

To the top side (back face) of the bent portion P of the body 6A of the boom 6, there is fixed a pivot member 11 formed of a pair of right and left plate members. This pivot member 11 has a substantially triangular shape as seen in its side view and two pins 14A, 14B are attached to the vicinity of the apex of the triangle.

And, to these pins 14A, 14B, there are connected the base of a cylinder tube 7B of the boom cylinder 7 and a base of a cylinder tube 9B of the arm cylinder 9, respectively. In place of the two pins 14A, 14B, a single pin can be used commonly for connecting and supporting the two cylinders 7,9.

At a longitudinally intermediate position in the back face of the body 6A, i.e. forwardly of the center (apex) of the bent portion P where the pivot member 11 is fixed, there is formed an upwardly open outlet opening (insertion hole) 12C allowing insertion of hydraulic oil pipes 34A for feeding pressure oil to the boom cylinder 7 and the arm cylinder 9 at one time.

To the leading end member 6C provided at the leading end of the boom 6, the base of the arm 8 is connected via a connecting pin (pivot shaft) 17. And, to the base of the arm 8, a pair of right and left connecting brackets 16 are fixedly attached by welding.

Figure 5:
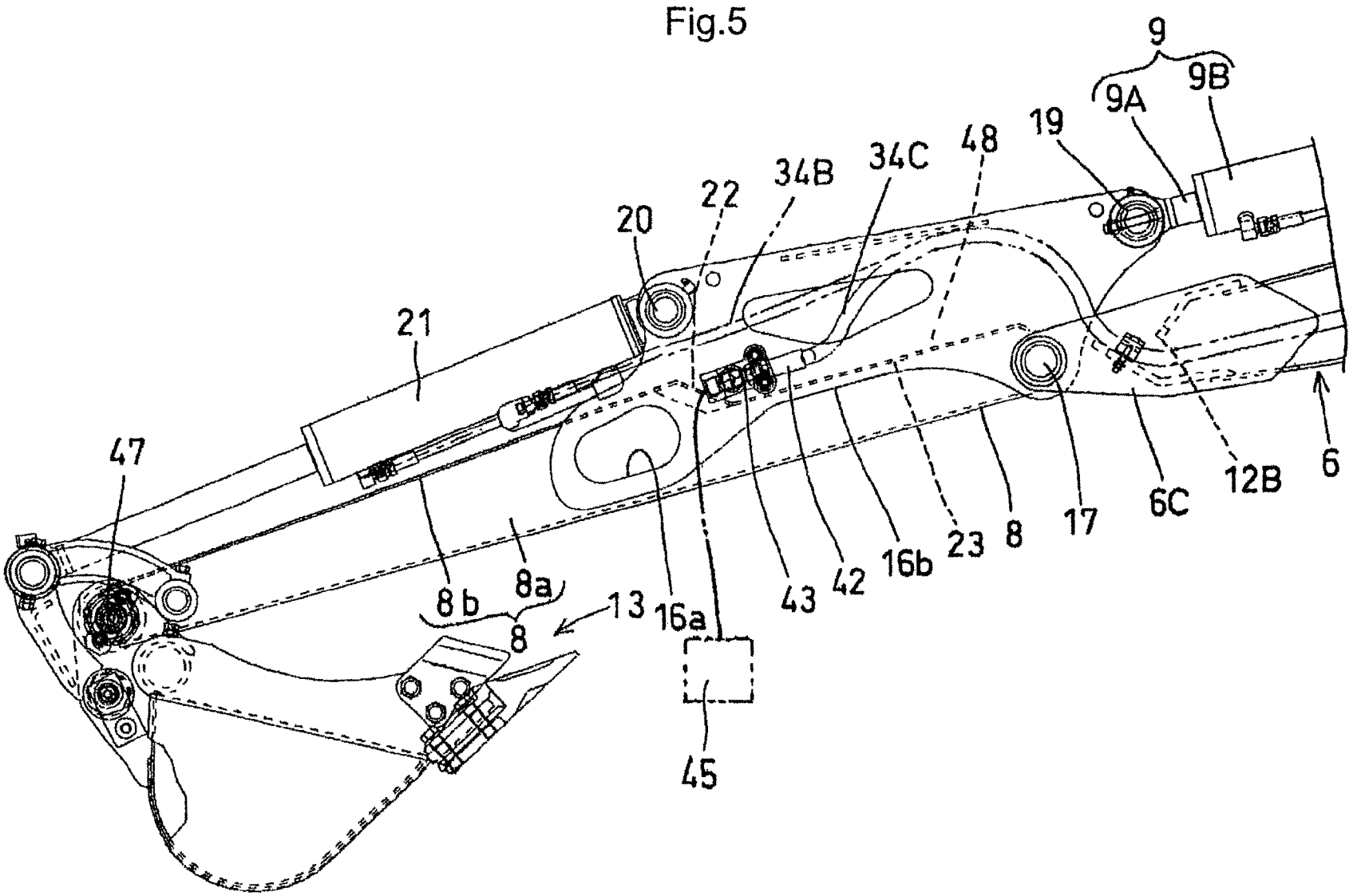
FIG. 5 is a side view showing a half of a leading end area of the boom assembly.
Figure 10:
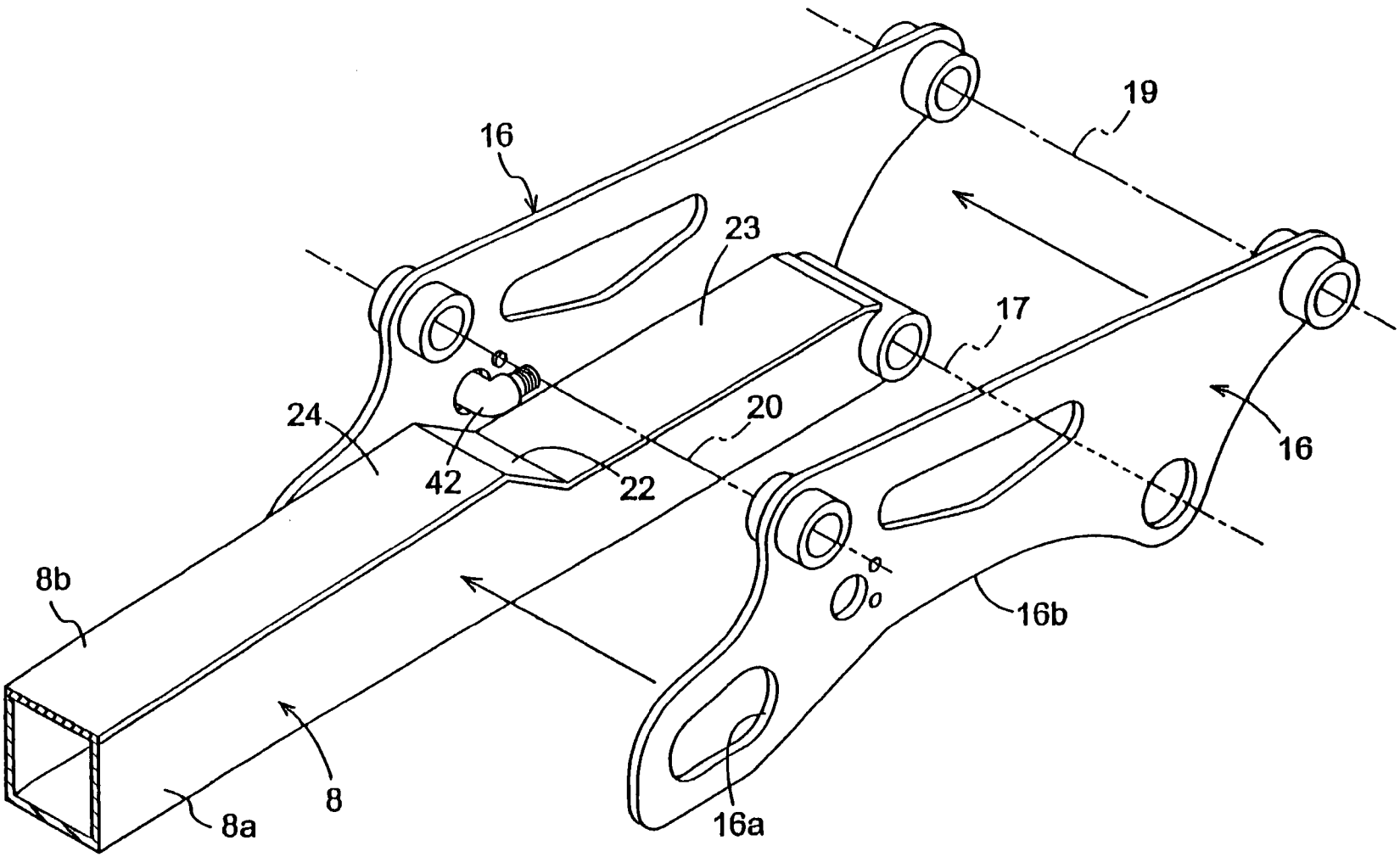
FIG. 10 is a perspective view showing layout of the arm, connecting plates and a hydraulic oil pipe.

As shown in FIG. 5 and FIG. 10, the arm 8 is formed by fixing a top plate 8*b* to the upper edge of an upwardly open channel member 8*a*. And, holes for the connecting pin (arm pivot shaft) 17 are formed at the base portion of the channel member 8*a*. Further, the opposed side walls of the channel member 8*a* are cutaway by a certain amount for half of the base end portions thereof. Therefore, the top plate 8*b* for closing the upward opening of this channel member 8*a* comprises an intermediately bent shape sectioned along the length thereof into an upper portion 24 and a lower portion 23 across a stepped portion 22 formed therebetween. To the opposed side faces of the arm 8, the pair of right and left connecting brackets 16 are welded.

Referring more particularly to the arm 8, in the area thereof having the upper portion 24 extending from the leading end portion pivotally supporting the bucket 13 by the connecting pin 47 to the stepped portion 22, the arm is formed as a progressively widened tubular structure. In the area thereof having the lower portion 23 extending from the stepped portion 22 to the base end, the arm 8 is formed as a tubular structure having a rectangular cross section with parallel upper and lower edges. The use of this two-stepped structure for the arm 8, rather than a structure having a gradually and continuously reduced height toward the leading end, provides the advantage of allowing for a greater length for welding available between the right and left connecting brackets 16. Further, the right and left connecting brackets 16 project upward from the top plate 8*b* of the arm 8, so that the hydraulic oil pipes 34 can be disposed with good margin in a protection space 48 created by these projecting portions of the right and left connecting brackets 16 and the lower portion 23 of the arm 8. At the base ends of the right and left connecting brackets 16 and the base ends of the channel member 8*a*, there are formed holes for the connecting pin (arm pivot shaft) 17.

To the leading end of the projecting portions of the right and left connecting brackets 16, the bucket cylinder 21 is connected via a pin 20 provided to extend through and between the right and left connecting brackets 16. At the base end thereof, the cylinder rod 9A of the arm cylinder 9 is connected via a pin 19 provided to extend through and between the right and left connecting brackets 16.

Each of the right and left connecting brackets 16 defines a cutout hole 16*a*, a recess 16*b* and so on for achieving weight reduction as well as increase in the total length available for its welding to the arm 8.

The insertion hole 12B of the leading end member 6C is provided as an outlet opening for taking out the hydraulic oil pipes 34B, 34C for feeding pressure oil to the bucket cylinder 21, the external hydraulic implement 45, etc. to the side of the arm 8.

The hydraulic oil pipe 34B for the bucket cylinder 21 extends through the entire length of the body 6A of the boom 6 to the outside from the insertion hole 12B. The hydraulic oil pipe 34C disposed along the hydraulic oil pipe 34B is an oil takeoff pipe for the service port for feeding pressure oil when the external hydraulic implement 45 such as a breaker, an auger or the like is to be used instead of the bucket 13.

Adjacent the stepped portion 22 and at the projecting portions of the right and left connecting brackets 16 creating the protection space 48 there is disposed a pipe joint 42. More particularly, this pipe joint 42 is disposed within the protection space 48 and at a position closer to the base of the arm 8 than to the bucket cylinder 21 not to be overlapped with the bucket cylinder 21 in the longitudinal direction of the arm 8. This disposing arrangement is indented for avoiding sliding contact with the hydraulic oil pipe 34B for the bucket cylinder 21.

The leading end of the pipe joint 42 extends through the connecting bracket 16 to the outside and to this leading end, a hose joint 43 is fixed by a screw. The pipe joint 42 and the hose joint 43 together constitute the service port fixed to the connecting bracket 16. To the hose joint 43, a hose 44 of the external hydraulic implement 45 is to be connected.

The hydraulic oil pipes 34 are connected to control valves 35 provided within the swivel table 2, and as shown in FIG. 8, these control valves 35 are operable respectively by the implement controllers 36 provided on the right and left sides of the driver's seat 30.

Figure 6:
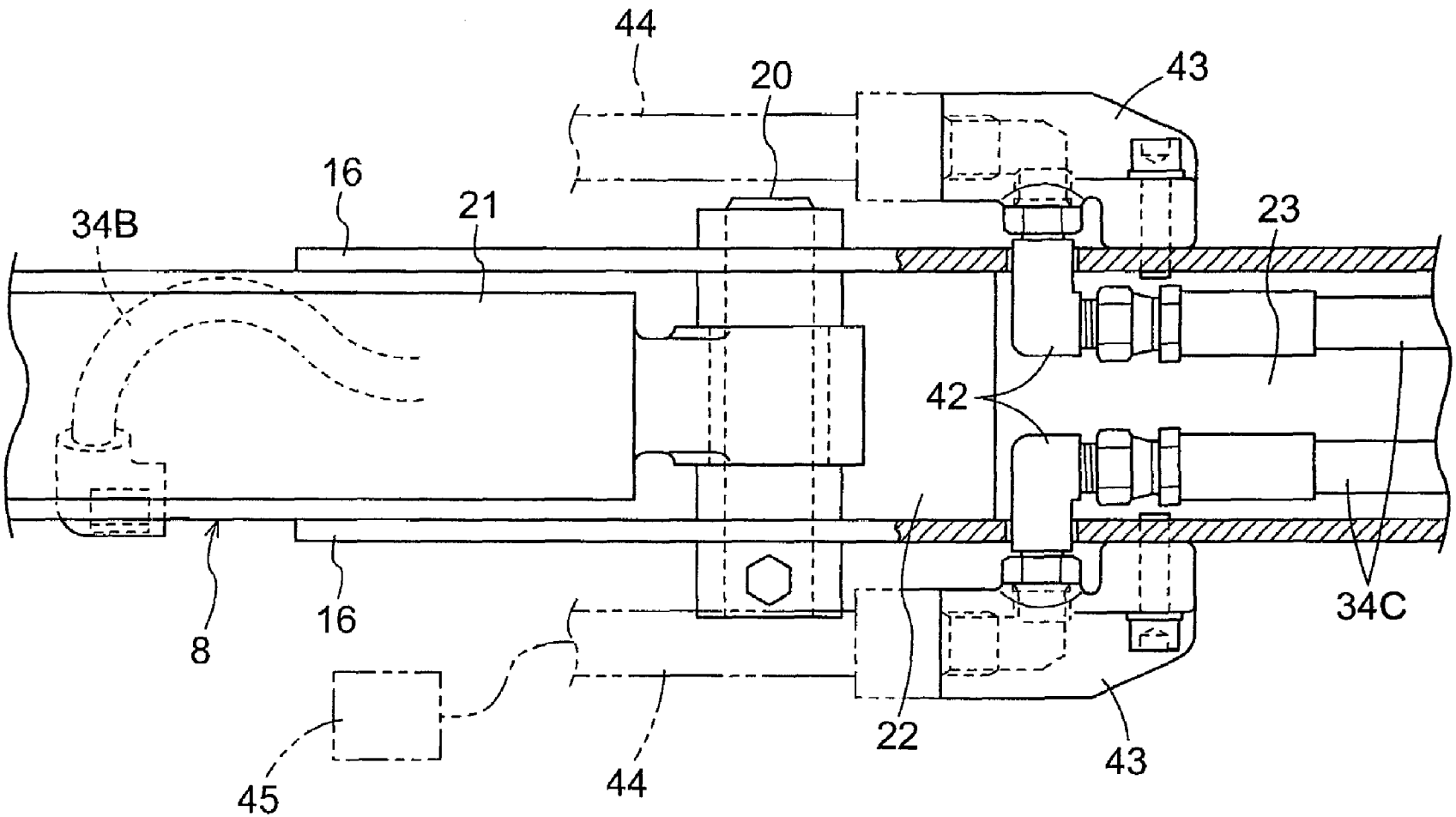
FIG. 6 is a plan view of an arm.

The hydraulic oil pipes 34 extend from the control valves 35 provided inside the swivel table 2 through the inside of the receiving bracket 3 to the outside as shown in FIGS. 1 and 3. The pipes 34 further extend through the insertion hole 4B of the swing bracket 4 and then extend through the insertion hole (introducing opening) 12A into the hollow boom 6. Among these pipes 34, the hydraulic oil pipes 34A extend through the insertion hole (outlet opening) 12C to the outside to be connected to the boom cylinder 7 or the arm cylinder 9. Whereas, as shown in FIGS. 1 and 5–6, the hydraulic oil pipes 34B, 34C further extend to reach the insertion hole (output opening) 12B provided at the leading end of the boom 6 and extends further out of the boom 6 and then through between the connecting pin 17 and the pin 19 to enter the space between the right and left connecting brackets 16 and reaches the protection space 48 upwardly of the lower portion 23 of the arm 8, in which the hydraulic oil pipe 34C is connected to the pipe joint 42 and further connected via the hose joint 43 to the hose 44 of the external hydraulic implement 45, whereas the other hydraulic oil pipe 34B further extends to be connected eventually to the bucket cylinder 21.

Incidentally, the fore and aft, right and left and upper and lower positional relationships among the respective components in the foregoing embodiment are at their best when provided as illustrated in FIGS. 1 through 10. However, the present invention is not limited thereto. The respective components and the constructions may be modified in various manners and combinations thereof may be changed also.

For instance, in the foregoing embodiment, the backhoe 25 is provided as the normal swiveling type vehicle in which the rear end of the swivel table 2 projects from the outermost ends of the right and left crawler traveling units 26. Instead, this may be a rear compact swiveling type in which the rear end of the swivel table substantially agrees with the outermost ends of the right and left crawler traveling units 26.

The hose joint 43 may be extended through the right and left connecting brackets 16 and fixed thereto. Or, both the pipe joint 42 and the hose joint 43 may be fixed to the right and left connecting brackets 16. Furthermore, the pipe joint 42 and the hose joint 43 may be constructed as an integrated unit.

The invention may be embodied in any other way than disclosed in the above detailed description without departing from the essential spirit thereof defined in the appended claims. All modifications apparent for those skilled in the art are intended to be encompassed within the scope of the invention defined by the claims.

The invention claimed is:

1. A boom assembly to be swingably supported to a receiving bracket provided at a front of a swivel table of a swiveling utility vehicle, comprising:

a swing bracket pivotally connectable with the receiving bracket of the swivel table to be pivotable about a vertical axis;

a hollow bent boom pivotally connected to the swing bracket;

a boom cylinder for lifting the boom;

a hollow arm pivotally connected to a leading end of the boom and pivotally supporting an implement at a leading end of the arm;

a pair of right and left connecting brackets attached to opposed side faces of a base end of the arm;

an arm cylinder provided between the connecting brackets and the boom;

an implement cylinder provided between the implement and the connecting brackets for operating the implement;

a hydraulic service port for a hydraulic implement; and a first hydraulic oil pipe for supplying pressure oil to the implement cylinder and a second hydraulic oil pipe for supplying oil pressure to the hydraulic service port;

wherein said hydraulic service port is provided in said connecting brackets, and said first and second hydraulic oil pipes extend through the inside of the hollow boom to be exposed to the outside from a back face area of the leading end of the boom and then further extend between said pair of right and left connecting brackets; and wherein said first hydraulic oil pipe is connected to said implement cylinder, and said second hydraulic oil pipe is connected to said hydraulic service port.

2. The boom assembly according to claim 1, wherein said hollow arm includes a top plate which is sectioned along the length thereof into an upper portion and a lower portion across a stepped portion therebetween; and said hydraulic service port comprises a pipe joint which is disposed in a space delimited by said lower portion and said pair of connecting brackets and arranged closer to the arm base portion than to the implement cylinder.

3. The boom assembly according to claim 2, wherein said pipe joint constituting the service port extends through the inside of the connecting brackets to the outside and a hose joint is connected to the leading end of the pipe joint.

4. The boom assembly according to claim 1, wherein said second hydraulic oil pipe is connected to a pipe joint of said hydraulic service port between said pair of right and left connecting brackets; and wherein said pipe joint is arranged closer to the arm base portion than to the implement cylinder in a longitudinal direction of said arm, and extends through the inside of the connecting brackets to the outside.

* * * * *